United States Patent [19]

Worth

[11] Patent Number: 4,664,458

[45] Date of Patent: May 12, 1987

[54] PRINTED CIRCUIT BOARD CONNECTOR

[75] Inventor: Sidney V. Worth, Flourtown, Pa.

[73] Assignee: C W Industries, Southampton, Pa.

[21] Appl. No.: 777,663

[22] Filed: Sep. 19, 1985

[51] Int. Cl.[4] ..... H01R 9/09

[52] U.S. Cl. ..... 339/17 M; 174/138 D; 339/64 M

[58] Field of Search ..... 339/17 M, 17 LM, 17 CF, 339/64 R, 64 M; 361/403, 412, 413; 174/138 D

[56] References Cited

U.S. PATENT DOCUMENTS

| | | | |
|---|---|---|---|
| 2,730,683 | 1/1956 | Ayres et al. | 361/413 |
| 2,858,515 | 10/1958 | Thunander et al. | 339/17 |
| 2,999,997 | 9/1961 | Tuchel | 361/413 |
| 3,043,942 | 7/1962 | Wickwire, III et al. | 219/19 |
| 3,173,732 | 3/1965 | James | 339/17 |
| 3,175,732 | 3/1965 | Unger | 222/134 |
| 3,196,377 | 7/1965 | Minich | 339/176 MP |
| 3,215,968 | 11/1965 | Herrmann | 339/17 |
| 3,270,311 | 8/1966 | Deer et al. | 339/17 |
| 3,408,452 | 10/1968 | Ruehlemann | 361/414 |
| 3,533,045 | 10/1970 | Henschen | 361/413 |
| 3,551,750 | 12/1970 | Sterling | 361/413 |
| 3,568,001 | 3/1971 | Straus | 361/413 |
| 3,588,785 | 6/1971 | Hardardt | 339/64 M |
| 3,596,138 | 7/1971 | Lehrfeld | 361/413 |
| 3,609,463 | 9/1971 | Laboue | 361/413 |
| 3,638,033 | 1/1972 | Johnson et al. | 361/505 |
| 3,643,201 | 2/1972 | Harwood | 361/413 |
| 3,652,899 | 3/1972 | Henschen | 174/138 |
| 3,681,517 | 8/1972 | Meyn | 174/138 |
| 3,688,635 | 9/1972 | Fegen | 174/138 |
| 3,691,436 | 9/1972 | Maijers et al. | 174/138 |
| 3,701,071 | 10/1972 | Landman | 339/4 |
| 3,704,486 | 12/1972 | Blacklock | 174/138 D |
| 3,723,635 | 3/1973 | Smith | 339/398 |
| 3,727,168 | 4/1973 | Henschen et al. | 361/413 |
| 3,753,048 | 8/1973 | Tuck et al. | 361/413 |
| 3,832,603 | 8/1974 | Cray et al. | 361/413 |
| 3,836,704 | 9/1974 | Coules | 174/138 |
| 3,848,952 | 11/1974 | Tighe, Jr. | 174/138 |
| 3,850,492 | 11/1974 | Moore | 361/413 |
| 3,923,359 | 12/1975 | Newsam | 361/414 |
| 4,161,346 | 7/1979 | Cherian | 339/17 M |
| 4,168,877 | 9/1979 | Little et al. | 361/413 |
| 4,200,900 | 4/1980 | McGeorge | 174/138 |
| 4,219,172 | 8/1980 | Murrayama | 174/138 |
| 4,230,383 | 10/1983 | Burnstein et al. | 339/258 R |
| 4,417,297 | 11/1983 | Oyama et al. | 174/138 |
| 4,430,776 | 2/1984 | Shimizu et al. | 174/138 |
| 4,449,016 | 5/1984 | Best | 174/138 |
| 4,470,178 | 9/1984 | Matsui | 174/138 |
| 4,473,204 | 9/1984 | Bohm | 174/138 |
| 4,482,937 | 11/1984 | Berg | 361/413 |
| 4,495,380 | 1/1985 | Ryan et al. | 174/138 |
| 4,495,548 | 1/1985 | Matsui | 174/138 |
| 4,502,193 | 3/1985 | Harmon et al. | 174/138 |
| 4,511,196 | 4/1985 | Schuler et al. | 29/842 |

FOREIGN PATENT DOCUMENTS

| | | | |
|---|---|---|---|
| 2454957 | 8/1976 | Fed. Rep. of Germany | 174/138 D |
| 69606 | 11/1958 | France . | |

*Primary Examiner*—Neil Abrams

*Attorney, Agent, or Firm*—Seidel, Gonda, Goldhammer & Abbott

[57] ABSTRACT

An electrical connector comprises an elongated insulator block having a plurality of transverse channels extending around the front, upper and lower sides thereof and at least partially around a rear side thereof. A plurality of electrically conductive resilient contacts are disposed in the channels. Each contact has a generally C-shaped profile and a generally U-shaped projection in an intermediate portion thereof. Each contact is partially bifurcated on opposite sides of the intermediate portion along a longitudinal dimension of the contact, thereby defining upper and lower pairs of contact arms. The channels are contoured to substantially the shape of the contacts, including a generally U-shaped indentation slightly larger in dimension than the U-shaped projection to permit each contact to float in its respective channel.

17 Claims, 10 Drawing Figures

FIG. 6
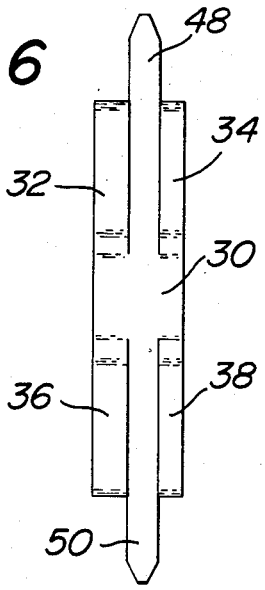
FIG. 7
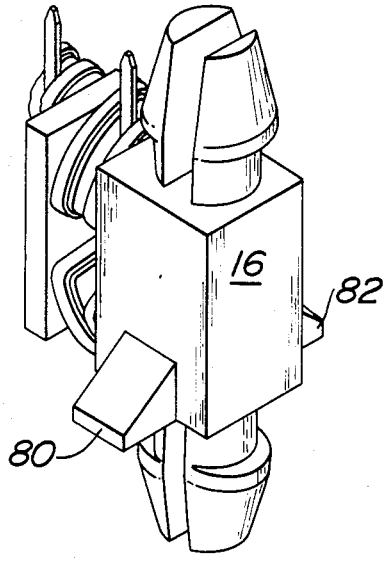
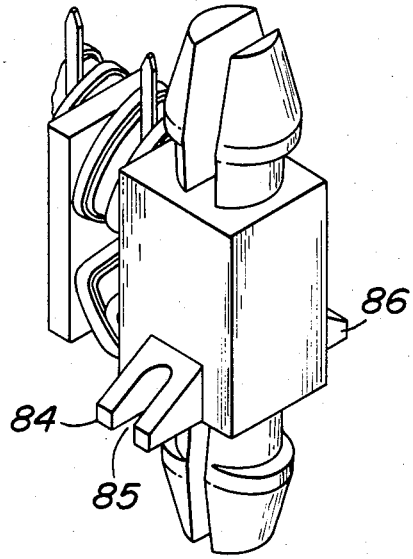
FIG. 8
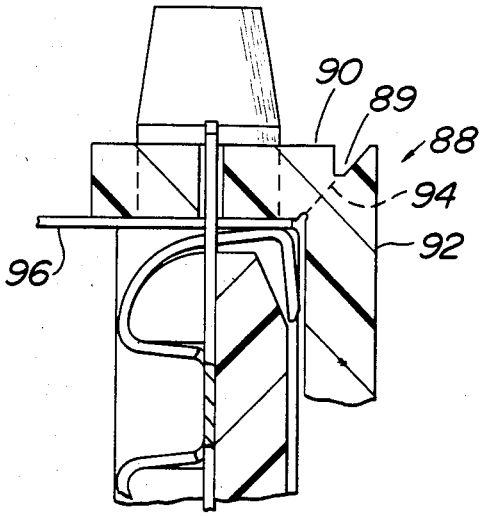
FIG. 9

PRINTED CIRCUIT BOARD CONNECTOR

BACKGROUND OF THE INVENTION

The present invention relates generally to electrical connectors for use with printed circuit boards. More particularly, the present invention is directed to a connector for both electrically and mechanically interconnecting a pair of circuit boards in stacked relationship. The present invention eliminates the need for spacer elements required by prior art interconnecting apparatus and acts as both a mechanical spacer and electrical conductor.

A problem with prior art printed circuit board connectors of the present type is that their manufacture is time consuming and expensive. Additionally, their application is cumbersome because tools are required both to connect and disconnect the circuit boards from the connector. Moreover, known connectors of this type are not reliable because reliable electrical contact is not guaranteed between the circuit board conductors and the individual contact elements in the connector in extreme conditions. Still further, known connectors of this type are suitable for making electrical connection between one side of each circuit board only and provide no simple means for making an electrical connection to the opposite sides of the circuit boards.

The present invention overcomes these failings of the prior art.

SUMMARY OF THE INVENTION

An electrical connector for mechanically and electrically interconnecting a pair of printed circuit boards comprises an elongated insulator block having front, rear, upper and lower sides. A plurality of transverse channels extends about the front, upper and lower sides and about at least a portion of the rear side.

A plurality of electrically conductive, resilient contacts are disposed on the insulator block, one in each channel. Each contact has at least partially curved upper and lower contact elements extending from an intermediate portion thereof. The upper and lower contact elements are normally biased upwardly and downwardly, respectively, from the intermediate portion so as to provide the contact with a generally C-shaped profile. A generally U-shaped projection is disposed at the intermediate portion of the contact. The upper and lower contact elements are bifurcated along a longitudinal dimension of the contact to define upper and lower pairs of independent contact arms. Each contact arm has a generally flat portion adjacent its distal end and defines a contact area for making electrical contact with a conductive trace on a printed circuit board.

The channels in the insulator block are contoured to substantially the shape of the contacts and include shoulders which, when the contacts are placed in the channels, are aligned with the contact arms. The channels also include a U-shaped indentation slightly larger in dimension than and adapted to receive the U-shaped projection, thus permitting the contact to float in its channel. In its normal relaxed position, each contact arm is biased away from its respective shoulder and only a portion of each contact arm contacts a portion of the shoulder. As a circuit board is installed on the connector, the circuit board applies a contact force to the contact area of each contact, thereby deflecting each contact arm toward its respective shoulder. A moment arm defined by the distance between the point where the contact arm first contacts the shoulder and the point where the contact force is applied decreases nonlinearly with each deflection of the contact arm by a unit distance. The non-linear relationship between contact force and the moment arm is due to the curvature of the shoulders. Thus, the amount of contact force required to further deflect each contact arm increases disproportionately with further deflection of each contact arm, and hence the reactive force applied by the contact to the circuit board also increases disproportionately.

Each contact arm also comprises a contact leg integral with the contact arm that extends perpendicularly from the distal end thereof. The contact leg contacts a portion of the channel extending about the rear side of the insulator block when the contact arm is fully deflected to prevent the contact arm from sitting flat on its respective shoulder. This insures that each contact arm maintains a reliable electrical connection between it and a respective conductive trace on the circuit board.

In one embodiment of the invention, selected contacts may further comprise one or two integral fingers longitudinally extending from the intermediate portion of the contact and between adjacent contact arms. In this embodiment, the insulator block further comprises a groove defined by a space between adjacent shoulders in each channel for receiving the finger. The fingers extend beyond the insulator block and mate with spatially aligned, plated through holes in the printed circuit board for establishing electrical conductivity between the contact and the side of the printed circuit board facing away from the contact.

Retaining means for securing the printed circuit boards to the connector and for insuring continued electrical contact are provided. In the preferred embodiment, the retaining means comprise a first pair of barbs disposed on opposite ends of the upper side of the insulator block and a second pair of barbs disposed on opposite ends of the lower side of the insulator block. Each barb comprises a pair of barb halves separated by a distance so as to be compressible by a force toward each other. Insertion in and removal from spatially aligned holes in the printed circuit board is achieved when a force compresses the barbed halves together, e.g., as occurs when the periphery of a hole in the printed circuit board urges the barb halves together. In the preferred embodiment, the distance between the barb halves of the first pair of barbs is greater than the distance between the barb halves of the second pair of barbs. Thus, the compression force required to insert and remove the first pair of barbs into and from the spatially aligned holes in the printed circuit board is greater than that required for the second pair of barbs. This feature permits a circuit board connected to an upperside of the connector to be more easily "stripped" from the connector than a circuit board connected to the lower side.

The barbs permit easy installation and removal of circuit boards. A circuit board is electrically and mechanically connected to the connector by aligning the barbs with holes in the circuit board and pressing the connector and circuit board together. A snap-fit is thus achieved. Circuit board removal is achieved by simply applying an upward force on the circuit board so as to "strip" the circuit board from the connector.

The insulator block may be provided with integral support pads projecting perpendicularly outward from the front and rear sides of opposite ends thereof. The support pads are disposed so that the circuit board rests on the support pads when snapped onto the connector. The support pads aid in preventing the circuit board from wobbling when installed on the connector.

The connector of the present invention also permits electrical connection between the individual contacts of the connector and the individual conductors of a ribbon cable. An elongated insulator bar has mounting holes spatially aligned with a pair of the barbs. The insulator bar also has a thickness so as to permit a ribbon cable to be secured between the insulator bar and the insulator block to establish electrical contact between each of the conductors in the ribbon cable and the contacts. The insulator bar may take a L shape if the ribbon cable terminates at the connector. In such case, the insulator bar has a narrowed portion at its corner to permit one leg of the insulator bar to be snapped off in the event that it is desired to daisy chain the ribbon cable from connector to connector.

BRIEF DESCRIPTION OF THE DRAWINGS

FIG. 6 is a front plan view of the contact illustrated in FIG. 5.

FIG. 7 is a partial perspective view of the present invention and illustrates one embodiment of the support pads.

FIG. 8 is a partial perspective view of the present invention and illustrates another emboidment of the support pads used in the practice of this invention.

FIG. 9 is a cross-sectional view illustrating the insulator block and a contact disposed therein and further illustrates the use of the insulator bar to secure a ribbon cable to the connector.

DETAILED DESCRIPTION OF THE PREFERRED EMBODIMENT

Figure 1:
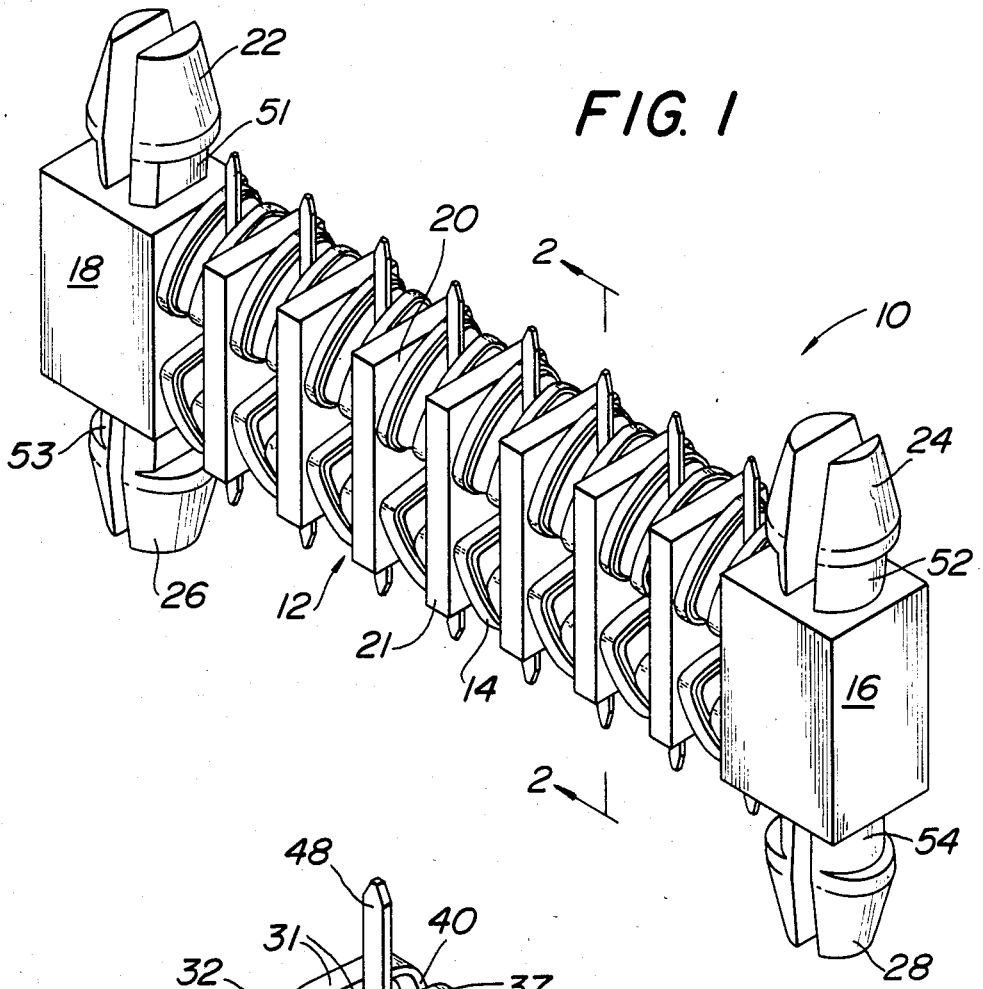
FIG. 1 is a perspective view of a preferred embodiment of the invention and illustrates an insulator block having a plurality of channels with contacts disposed therein.

Referring now to FIG. 1 there is illustrated an electrical connector labeled generally 10. Connector 10 comprises an elongated insulator block 12 having front side 13 and rear side 15 (FIG. 2) upper side 17 (FIG. 4) and lower side 19 (FIG. 3). Insulator block 12 has a plurality of channels 20 extending about the front, rear, upper and lower sides 13, 15, 17 and 19. Adjacent channels 20 are separated by walls 21 as shown. A contact 14 resides in each channel 20, in a manner to be described hereinafter.

Insulator block 12 has a right terminal portion 16 and a left terminal portion 18 as shown. Disposed on opposite terminal portions 16, 18 of terminal block 12 and on the upper and lower sides 17, 19 thereof are a plurality of retaining barbs 22, 24, 26 and 28 that serve a purpose hereinafter described. Barbs 22, 24, 26 and 28 also comprise stems 51, 52, 53 and 54 respectively. The barbs and stems are integral with the insulator block 12.

Figure 5:
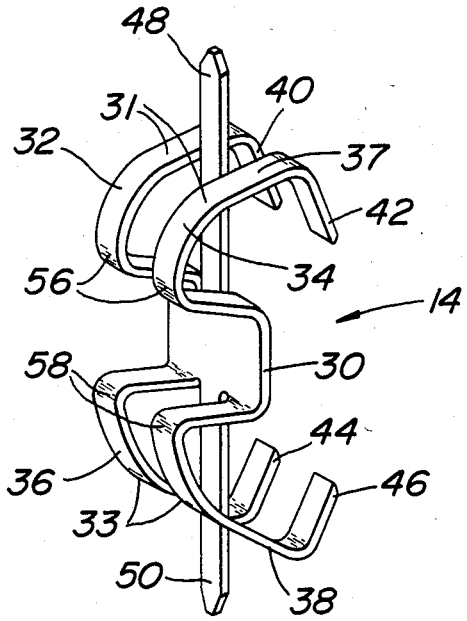
FIG. 5 is a perspective view of one of the contacts used in connection with the practice of the present invention.

Referring now to FIG. 5, details of contacts 14 will be described. Each contact 14 comprises an electrically conductive resilient metal having partially curved upper and lower contact elements 31, 33, respectively. Contact elements 31, 33 are integral with and extend from an intermediate portion 30, as shown. Upper contact elements 31 are biased upwardly from the intermediate portion 30 while lower contact elements 33 are biased downwardly from intermediate portion 30. The overall arrangement of upper contact elements 31 and lower contact elements 33 is such as to provide contact 14 with a generally C-shaped profile, as illustrated.

The intermediate portion 30 of contact 14 has a U-shaped projection as shown. Additionally, the contact elements 31, 33 are bifurcated along a longitudinal dimension of contact 14 so as to define a pair of upper contact arms 32, 34 and a pair of lower contact arms 36, 38. The bifurcation of the contact elements provides a space between the upper contact arms 32, 34 and a space between the lower contact arms 36, 38 as shown. As illustrated in FIG. 6, contact arms 32 and 36 have a wider dimension than contact arms 34 and 38. The resonant frequency of contact arms 32 and 36 is thus diffent than the resonant frequency of contact arms 34 and 38. In extreme environments where the connector may undergo vibration, electrical contact between contacts 14 and conductive traces on a printed circuit board will be ensured even if the vibration occurs at the resonant frequency of one of the contact arms 32, 36 or 34, 38.

Returning now to FIG. 5, the contact legs 32, 34, 36, 38 additionally comprise integral contact legs, 40, 42, 46, 48, respectively. Each contact leg, e.g., 42, extends perpendicularly from the distal end of its respective contact arm, e.g., 32. Contact legs 40, 42, 46, 48 perform a function described hereinafter. Also, each contact arm 32, 34, 36, 38 has a flat portion, e.g., 37, adjacent its distal end defining a contact area for making electrical contact with a conductor, such as a trace on a printed circuit board.

According to one embodiment of the invention, each contact 14 may comprise one finger 48 or two fingers 48, 50 that are integral with the intermediate portion 30 (see FIG. 6) and extend longitudinally between pairs of contact arms. Thus, finger 48 is integral with intermediate portion 30 and extends longitudinally upward, through the space defined by the bifurcated contact elements 31, between the contact arms 32, 34. Similarly, finger 50 is integral with intermediate portion 30 and extends longitudinally downward, through the space defined by bifurcated contact elements 33, between contact arms 36, 38. The fingers 48, 50 are provided for applications wherein it is desired to establish electrical contact between a selected contact 14 and a conductor on an opposite side of the printed circuit board. Fingers 48, 50 are adapted to mate with spacially aligned, plated through holes in the printed circuit board for this purpose.

Figure 2:
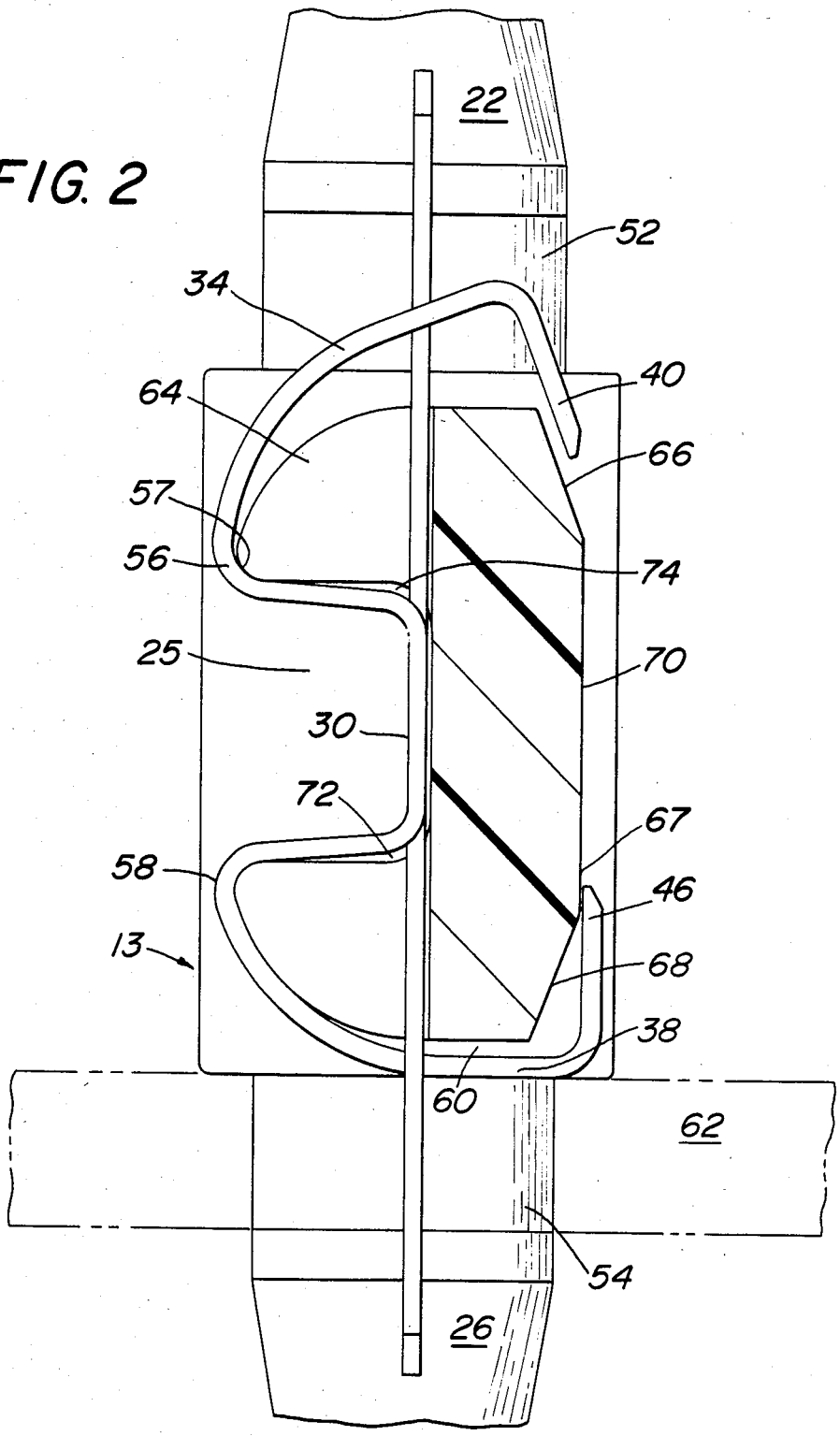
FIG. 2 is a cross-sectional view taken along line 2—2 of FIG. 1.
Figure 3:
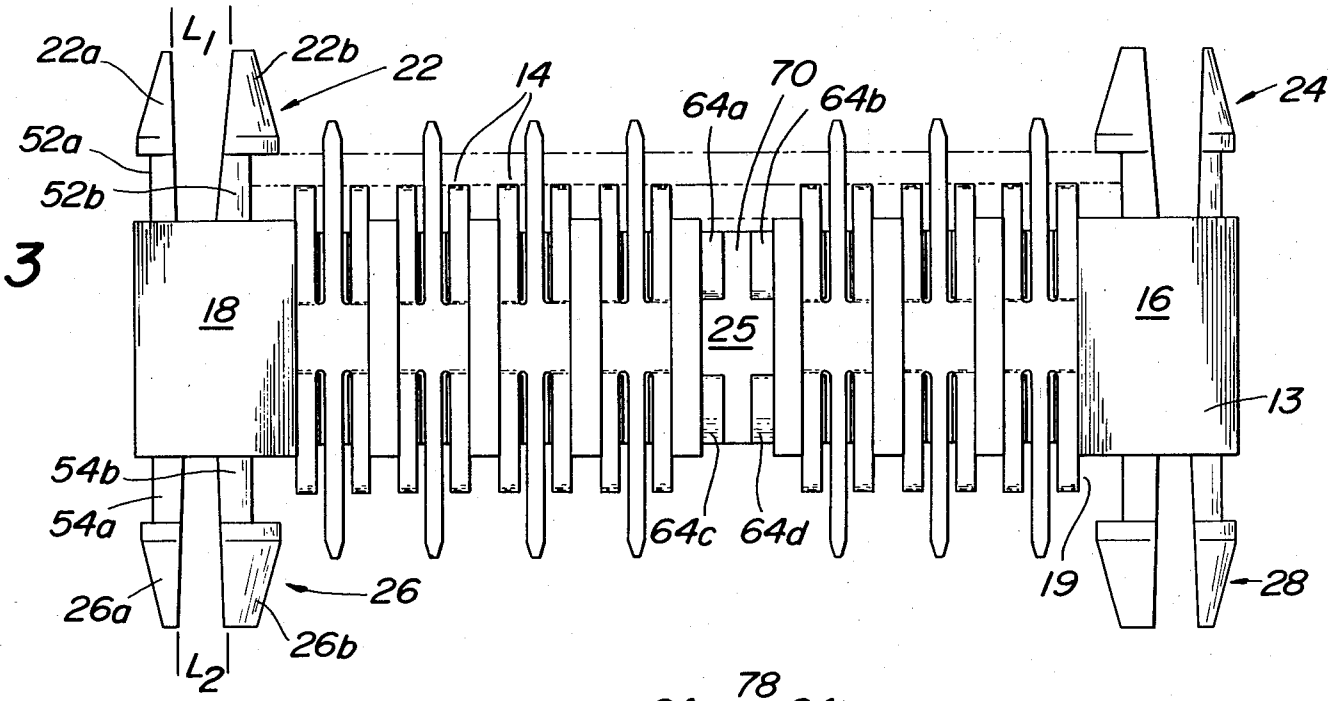
FIG. 3 is front plan view of the invention illustrated in FIG. 1.

Turning now to FIG. 2, it will be seen that each channel 20 is contoured substantially to the shape of the contacts 14. Thus, each channel 20 is formed of a U-shaped indentation 25 slightly larger in dimension than the dimension of the U-shaped projection in the intermediate portion 30 of contact 14. The larger dimension of the indentation 25 permits each contact to float up and down in its respective channel. This is an important feature of the invention and permits the contact to account for variations that often occur in printed circuit board thickness, or in variations that may occur in the size of ribbon cable that may be connected to one end of the connector 10. Each channel 20 also comprises curved shoulders 64, best illustrated in FIGS. 3 and 4. A pair of adjacent upper shoulders 64*a* and 64*b* are aligned with contact arms 32, 34 when contact 14 is inserted in its respective channel 20. Similarly, lower adjacent shoulders 64*c*, 64*d* are aligned with contact arms 36, 38 when contact 14 is inserted in its respective channel 14. As shown in FIG. 2, when the contact arms are relaxed, as is contact arm 34 if FIG. 2, they are biased away from their respective shoulders. Curved portions 56, 58 of contacts 14 contact only a portion 57 of their respective shoulders 64, when in the relaxed position.

The channel extending about the rear side 15 of insulator block 20 is defined in part by chamfered portions 66, 68. As shown, when a contact arm is relaxed, e.g., contact arm 34, its associated contact leg, e.g., 40, is generally parallel to the chamfered portion, e.g., 66.

It will be noted that when a contact 14 is inserted in its respective channel 20, the smaller dimension of the projection of the intermediate portion 30 defines spaces 72, 74 that permit the contact 14 to float vertically, as previously discussed. The contact legs 40, 44 (as well as 42 and 46) wrap around the insulator block and overlay the chamfered portions 66, 68 to prevent the contact 14 from falling out when it is in its relaxed position. See FIG. 2.

In FIG. 2, contact arm 34 is relaxed and contact arm 38 is deflected. As previously mentioned, when a contact arm is in its relaxed state, only a portion of that contact arm (e.g., 56) contacts a portion (e.g., 57) of its respective shoulder. The contact arms, however, deflect toward their respective shoulders when a contact force is applied thereto, such as by the insertion of a printed circuit board 62. As each contact arm is deflected, more of its surface is brought into contact with its respective shoulder. See contact arm 38. Thus, a moment arm defined by the distance between the point where the contact arm first contacts the shoulder and the point where the contact force is applied decreases as the contact arm is deflected closer to its respective shoulder. Due to the curvature of the shoulders 64 and the curvature of the contact arms 32, 34, 36, 38, a deflection of a contact arm by a unit distance results in a correponding decrease in the moment arm according to a non-linear function. For each deflection of the contact arm closer to its shoulder 64, a greater contact force is required to deflect the contact arm another unit distance. The relationship between deflection distance and contact force is thus non-linear. This non-linear relationship is advantageous because, for each deflection by a unit distance, the contact urges the corresponding printed circuit board conductor with a disproportionately greater reactive force, thereby ensuring electrical contact even in extreme conditions.

The contact legs 40, 42, 46 and 48 prevent their respective contact arms from sitting flat on their respective shoulders 64 when fully deflected. Thus, as illustrated in FIG. 2, the tip of contact leg 46 contacts the edge 67 of wall 70 and prevents any further deflection of contact arm 38 toward its shoulder. Thus, a space 60 resides between the contact arm 38 and the insulator block 12 even when contact arm 38 is fully deflected. This feature ensures that electrical contact is always maintained between contact arm 38 and a printed circuit board conductor.

As illustrated in FIG. 3, retaining means according to the present invention comprise a first pair of barbs 22, 24 disposed on opposite ends of the upper side 17 of insulator block 12 and a second pair of barbs 26, 28 disposed on the opposite ends of lower side 19 of insulator block 12. The barbs 22, 24, 26, 28 are integral with and extend from terminal portions 16, 18. Only the details of upper barb 22 and lower barb 26 will be discussed herein, it being understood that this discussion applies equally to barbs 24 and 28.

Upper barb 22 comprises a pair of barb halves 22*a*, 22*b* integral with a pair of stem halves 52*a*, 52*b* integral with terminal portion 18. For ease of discussion, it will be understood that reference to the barb halves 22*a*, 22*b* is meant to include stem halves 52*a*, 52*b*. Similarly, lower barb 26 comprises a pair of barb halves 26*a*, 26*b* integral with a pair of stems 54*a*, 54*b* integral with terminal portion 18. Again, for ease of discussion, reference to barb halves 26*a*, 26*b* will be meant to include stem halves 54*a*, 54*b*. A first distance $L_1$ is defined by the distance between barb halves 22*a*, 22*b* and a second distance $L_2$ is defined by the distance between barb halves 26*a* and 26*b*. As illustrated, the distance $L_1$ between the pair of upper barb halves 22*a*, 22*b* is greater than the distance $L_2$ between the pair of lower barb halves 26*a*, 26*b*. The difference in the distances $L_1$ and $L_2$ is due to the fact that barb halves 22*a*, 22*b* are somewhat narrower than barb halves 26*a*, 26*b*, i.e., barb 22 is constructed of less material than barb 26. For this reason, less compression force is required to urge barb halves 22*a* and 22*b* toward each other than is required to urge barb halves 26*a* and 26*b* toward each other. That is, barb halves 22*a*, 22*b* are normally biased away from each other but can be urged together by a compression force, such as would occur when the periphery of a hole in a printed circuit board contacts the uppermost portion of barb halves 22*a* and 22*b* and the printed circuit board is urged downwardly toward the connector. A similar compression force occurs when a printed circuit board installed on the connector 10 is pulled away therefrom, thus allowing the printed circuit board to be "stripped" away from the connector. Barb halves 26*a*, 26*b* are also normally biased away from each other and urged together when a similar compression force is applied thereto. Because a greater compression force is required to urge barb halves 26*a*, 26*b* toward each other, a greater force must be applied to install a printed circuit board on the lower side of connector 10, and similarly, a greater force must be applied to "strip" a printed circuit board away from the bottom of connector 10. As illustrated (FIG. 4), in their relaxed state, the overall shape of each barb 22, 24, 26, 28 is generally oval shaped. This permits a circuit board to be "snapped" over the barbs, as follows. When the barb halves are compressed toward each other by a compression force, such as would occur when the periphery of a hole in a printed circuit board contacts the barbs and the printed circuit board is pressed downwardly onto the barbs, the overall shape of each barb becomes generally circular with a diameter less than the diameter of the hole in the printed circuit board. The barb can then be fully inserted through the hole. After the barb has been fully inserted, the compression force no longer exists and the barb assumes its original oval shape. The printed circuit board is then locked onto the connector by the barb's lip portion, i.e., the portion where the barb meets the stem locks the board into place. For example, if the diameter of a printed circuit board hole into which the barb 22 is to be inserted is 0.125", then the widest dimension across the top of barb 22 (i.e., the length of the oval) could be made 0.124", but tapering outwardly to a dimension of 0.144" at the lip, i.e., the point where barb 22 meets stem 52.

Figure 4:
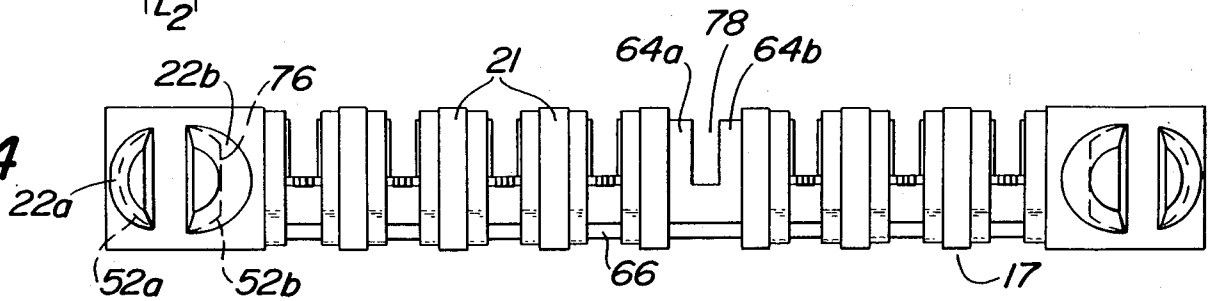
FIG. 4 is a top plan view of the invention illustrated in FIG. 1.

As shown in FIG. 4, the innermost side of each stem half may have a flat portion. Thus, the innermost stem half 52*b* of barb 22 has a flat side 76. The flat portions provide a guide surface for flexible circuits such as ribbon cable that may be used in connection with the present invention.

Turning now to FIGS. 7 and 8, it is shown that the invention may be provided with support pads disposed on opposite ends of the front and rear surfaces of the insulator block 12. As illustrated in FIG. 7, a pair of support pads 80, 82 are integral with the front and rear surfaces of terminal portion 16 and protrude perpendicularly therefrom. Similar support pads are provided on terminal portion 18. The support pads are substantially wedge-shaped and have a flat surface for cooperating with a printed circuit board installed on the connector 10 and are particularly useful when a tall connector 10 is provided, as the circuit boards would be spaced further apart. The support pads 80, 82 prevent the printed circuit board from wobbling when installed on the connector 10. The support pads 84, 86 illustrated in FIG. 8 are substantially identical to those illustrated in FIG. 7, but each have a notch 85 carved therein. The notch 85 permits the support pads 84, 86 to flex somewhat.

The present invention is not limited to use with printed circuit boards, but may also be used to establish electrical contact between each of the contacts 14 and the conductors of a ribbon cable 96, as illustrated in FIG. 9. A L-shaped insulator bar 88 comprises two perpendicular integral portions 90, 92 and a notch 89 adjacent the corner. The notch 89 defines a narrowed length of cross section as indicated by the dotted line 94. The portion 90 of insulator bar 88 has a thickness so as to permit the ribbon cable 96 to be secured between the portion 90 of insulator bar 88 and the insulator block 12 to establish electrical contact between each of the conductors in the ribbon cable and each of the contacts 14 in the connector 10. If ribbon cable 96 terminates at this particular connector 10, portion 92 of insulator bar 88 is left intact. However, if it is desired to daisy chain ribbon cable 96 from one connector to another, portion 92 may be removed from portion 90 by applying an upward force thereto, and hence snapping it off along the narrowed dimension 94.

Figure 10:
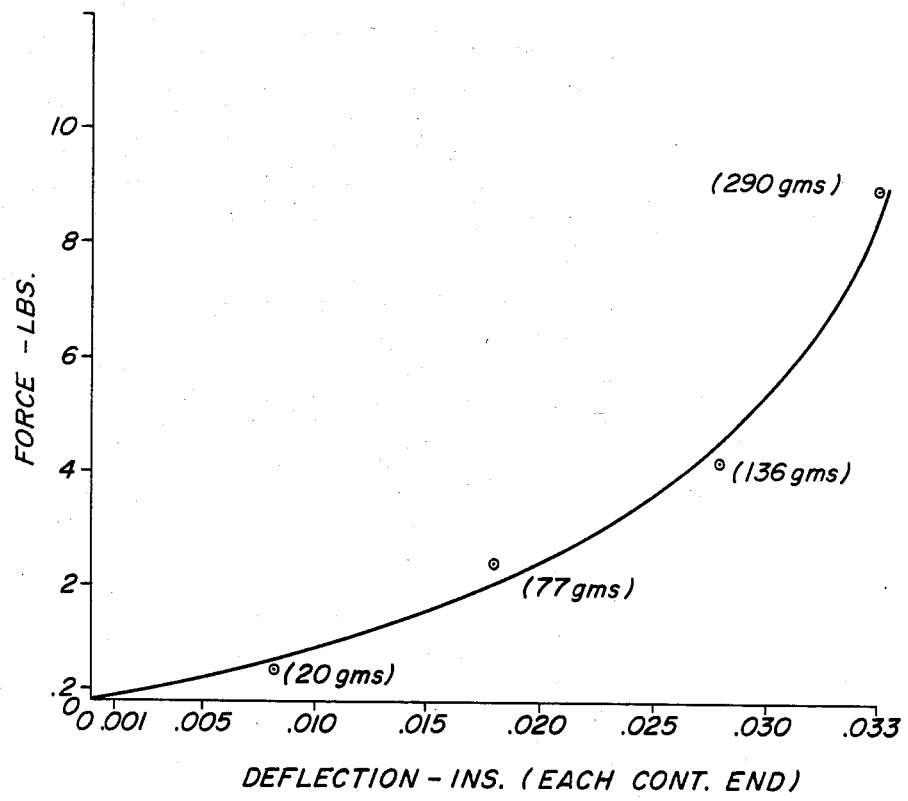
FIG. 10 is a graph illustrating the relationship between contact force and deflection distance according to one mode of the present invention.

The graph of FIG. 10 illustrates the non-linear relationship between contact force and deflection distance for one connector manufactured according to the teachings of the present invention. As can be seen, the contact force increases nonlinearly and disproportionately for each unit deflection of the contact.

The present invention may be embodied in other specific forms without departing from the spirit or essential attributes thereof and, accordingly, reference should be made to the appended claims, rather than to the foregoing specifications, as indicating the scope of the invention.

I claim:

1. An electrical connector comprising:

(a) an elongated insulator block having a plurality of transverse channels extending around front, upper and lower sides thereof and at least partially around a rear side thereof;

(b) a plurality of electrically conductive resilient contacts disposed in the channels, each contact having a generally C-shaped profile and a generally U-shaped projection in an intermediate portion thereof, each contact being partially bifurcated on opposite sides of the intermediate portion along a longitudinal dimension of the contact thereby defining upper and lower pairs of contact arms, the channels being contoured to substantially the shape of the contacts, including a generally U-shaped indentation slightly larger in dimension than the U-shaped projection so as to permit each contact to float in its respective channel; and (c) curved shoulders disposed in each channel and integral with the insulator block, one of said shoulders being aligned with and contacting a portion of each contact arm, the contact arms being normally biased away from their respective shoulders but being deflected toward their respective shoulders when a contact force is applied thereto, each contact arm having a moment arm defined by the distance between a point where the contact arm first contacts the shoulder and the point where the contact force is applied, the moment arm decreasing as the contact is deflected toward the shoulder so as to non-linearly increase the amount of contact force required to further deflect the contact arm.

2. A connector according to claim 1 further comprising retaining means disposed at opposite ends of the insulator block for mechanically securing materials having electrical conductors to the insulator block.

3. A connector according to claim 2 wherein the retaining means comprises a first pair of barbs disposed on opposite ends of the upper side of the insulator block and a second pair of barbs disposed on opposite ends of the lower side of the insulator block, each barb comprising a pair of barb halves separated by a distance so as to be compressible by a force toward each other to permit insertion and removal of each barb through holes in the materials, the compression force required to insert and remove one of the pairs of barbs into and from the holes being greater than that required for the other pair of barbs.

4. A connector according to claim 3 wherein the materials are printed circuit boards having mounting holes spatially aligned with a pair of barbs for mounting to the insulator block and further having conductors spatially aligned to make electrical contact with said plurality of contacts.

5. A connector according to claim 3 wherein at least one of the materials comprises an elongated insulator bar having mounting holes spatially aligned with a pair of barbs for mounting to the insulator block, the insulator bar having a thickness so as to permit a ribbon cable to be secured between the insulator bar and insulator block to establish electrical contact between each of the conductors in the ribbon cable and the contacts.

6. A connector according to claim 3 further comprising support pads disposed on opposite ends of the front and rear surfaces of the insulator block and protruding outwardly therefrom for providing support to the materials.

7. A connector for mechanically and electrically interconnecting a pair of circuit boards comprising:

(a) a plurality of electrically conductive resilient contacts each having (i) at least partially curved upper and lower contact elements extending from an intermediate portion, the upper and lower contact elements being normally biased upwardly and downwardly, respectively, from the intermediate portion so as to provide the contact with a generally C-shaped profile and (ii) a generally U-shaped projection at the intermediate portion, the upper and lower contact elements being bifurcated along a longitudinal dimension of the contact to define upper and lower pairs of independent contact arms, each contact arm having a generally flat portion adjacent its distal end defining a contact area for making electrical contact with conductive traces on the circuit boards and a contact leg extending substantially perpendicular from the distal end of the contact arm;

(b) an elongated insulator block having front, rear, upper and lower sides, a plurality of transverse channels extending about the front, upper and lower sides and about at least a portion of the rear side, one of the contacts being disposed in each channel, each channel being contoured to substantially the shape of the contact and including integral curved shoulders aligned with the contact arms, the contact arms being normally biased away from the shoulders, and further including a U-shaped indentation slightly larger in dimension than and aadapted to receive the U-shaped projection, thereby permitting each contact to float in its respective channel;

(c) a first pair of retaining barbs disposed on opposite ends of the upper side of the insulator block and a second pair of retaining barbs disposed on opposite ends of the lower side of the insulator block, each barb comprising a pair of barb halves separated by a distance so as to be compressible by a force toward each other to permit insertion and removal of each barb through spatially aligned holes in the printed circuit boards, the compression force required to insert and remove the first pair of barbs into and from the circuit board holes being less than that required for the second pair of barbs; and (d) support pads disposed at opposite ends of the insulator block and projecting outwardly therefrom, and having a flat surface for mating contact with the circuit boards so as to support said circuit boards when installed on said connector; whereby, as a circuit board is installed on the connector, each contact arm is deflected toward the shoulder with which it is aligned such that a moment arm associated with each contact arm decreases in length as the contact is deflected and the contact urges against the circuit board with a force that increases non-linearly as the contact is deflected, said contact legs contacting a portion of the channel on the rear side of the insulator block when the contact is fully deflected to prevent the contact arm from sitting flat on its respective shoulder, the retaining barbs securing the circuit boards to the connector.

8. A connector according to claim 7 wherein one contact arm of each of the pairs of contact arms has a wider dimension than the other contact arm of the pair, the wider contact arm thereby having a different resonant frequency than the other contact arm.

9. An electrical connector comprising:

(a) an elongated insulator block having a plurality of transverse channels extending around front, upper and lower sides thereof and at least partially around a rear side thereof;

(b) a plurality of electrically conductive resilient contacts disposed in the channels, each contact having a generally C-shaped profile and a generally U-shaped projection in an intermediate portion thereof, each contact being partially bifurcated on opposite sides of the intermediate portion along a longitudinal dimension of the contact thereby defining upper and lower pairs of contact arms, with an integral finger extending from the intermediate portion between adjacent contact arms and adapted to fit into a groove in the insulator block defined by a space between adjacent shoulders in each channel, the channels being contoured to substantially the shape of the contacts, including a generally U-shaped indentation slightly larger in dimension than the U-shaped projection so as to permit each contact to float in its respective channel; and (c) curved shoulders disposed in each channel and integral with the insulator block, one of said shoulders being aligned with and contacting a portion of each contact arm, the contact arms being normally biased away from their respective shoulders but being deflected toward the shoulder with which it is aligned when a contact force is applied thereto, each contact arm having a moment arm defined by the distance between a point where the contact arm first contacts the shoulder and the point where the contact force is applied, the moment arm decreasing as the contact is deflected toward the shoulder so as to non-linearly increase the amount of contact force required to further deflect the contact arm.

10. A contact for an electrical connector comprising a resilient electrically conductive metal having at least partially curved upper and lower contact elements integral with and extending from an intermediate portion and being biased upwardly and downwardly, respectively, from the intermediate portion so as to provide the contact with a generally C-shaped profile, and further having a generally U-shaped projection at the intermediate portion, the contact elements being bifurcated along a longitudinal dimension of the contact to define upper and lower pairs of independent contact arms, with at least one finger integral with the intermediate portion and extending therefrom between one of said pairs of contact arms, each contact arm having a generally flat portion adjacent its distal end defining a contact area and a contact leg integral with the contact arm and extending perpendicularly from the distal end of the contact arm.

11. A connector for mechanically and electrically interconnecting a pair of materials having electrical conductors comprising:

(a) an elongated insulator block having front, rear, upper and lower sides, a plurality of transverse channels extending about the front, upper and lower sides and at least partially about the rear side, and curved shoulders integral with the insulator block and disposed in the channel;

(b) a plurality of electrically conductive resilient contacts disposed in the channels, each contact having a generally C-shaped profile and an intermediate portion having generally a U-shaped projection, upper and lower ends of the contact being bifurcated along a longitudinal dimension of the contact to define upper and lower pairs of contact arms, a finger integral with the intermediate portion and extending therefrom between one of the pairs of contact arms, the insulator block having a groove defined by a space between adjacent shoulders through which the finger is adapted to extend, one contact arm of each of the pairs of contact arms having a wider dimension than the other, the wider contact arm thereby having a different resonant frequency than the other contact arm, each contact arm having a generally flat portion adjacent its distal end defining a contact area for making electrical contact with the conductors, each contact arm being aligned with one of the shoulders and being normally biased away therefrom, each contact arm being deflected toward the shoulder with which it is aligned when a contact force is applied thereto and having a moment arm that decreases in length as the contact force is applied according to a non-linear function, thereby causing the contact force to increase disproportionately for each unit deflection of the contact arm, each contact arm having a contact leg integral with the contact arm and extending perpendicularly from the distal end thereof, the contact leg contacting a portion of the channel extending about the rear side of the insulator block when the contact arm is deflected to prevent the contact arm from sitting flat on its respective shoulder, and each channel having a generally U-shaped indentation slightly larger in dimension than the dimension of the U-shaped projection for receiving the U-shaped projection and permitting the contact to float in the channel.

12. A connector according to claim 11 further comprising a first pair of retaining barbs disposed on opposite ends of the upper surface of the insulator block and a second pair of retaining bars disposed on opposite ends of the lower surface of the insulator block, each barb comprising a pair of barb halves separated by a distance so as to be compressible by a force toward each other to permit insertion into and removal from holes in the materials to be interconnected.

13. A connector according to claim 12 wherein the distance between the barb halves of the first pair of barbs is greater than the distance between the barb halves of the second pair of barbs, the compression force required to insert and remove the first pair of barbs into and from the holes being greater than that required for the second pair of barbs.

14. A connector according to claim 13 wherein the insulator block further comprises integral support pads projecting perpendicularly outward from the front and rear surfaces of opposite ends of the insulator block.

15. A connector for mechanically and electrically interconnecting a pair of circuit boards comprising:

(a) a plurality of electrically conductive resilient contacts each having (i) at least partially curved upper and lower contact elements extending from an intermediate portion, the upper and lower contact elements being normally biased upwardly and downwardly, respectively, from the intermediate portion so as to provide the contact with a generally C-shaped profile and (ii) a generally U-shaped projection at the intermediate portion, the upper and lower contact elements being bifurcated along a longitudinal dimension of the contact to define upper and lower pairs of independent contact arms, one contact arm of which has a wider dimension and thereby a different resonant frequency than the other contact arm of the pair, each contact arm having a generally flat portion adjacent its distal end defining a contact area for making electrical contact with conductive traces on the circuit boards and a contact leg extending substantially perpendicular from the distal end of the contact arm with selected contact elements having a finger integral with the intermediate portion and extending between its pair of contact arms, the insulator block having a groove defined by a space between adjacent shoulders adapted to receive the finger extending through the groove and mating with a conductive trace on the circuit board;

(b) an elongated insulator block having front, rear, upper and lower sides, a plurality of transverse channels extending about the front, upper and lower sides and about at least a portion of the rear side, one of the contacts being disposed in each channel, each channel being contoured to substantially the shape of the contact and including integral curved shoulders aligned with the contact arms, the contact arms being normally biased away from the shoulders, and further including a U-shaped indentation slightly larger in dimension than and adapted to receive the U-shaped projection, thereby permitting each contact to float in its respective channel;

(c) a first pair of retaining barbs disposed on opposite ends of the upper side of the insulator block and a second pair of retaining barbs disposed on opposite ends of the lower side of the insulator block, each barb comprising a pair of barb halves separated by a distance so as to be compressible by a force toward each other to permit insertion and removal of each barb through spatially aligned holes in the printed circuit boards, the compression force required to insert and remove the first pair of barbs into and from the circuit board holes being less than that required for the second pair of barbs; and (d) support pads disposed at opposite ends of the insulator block and projecting outwardly therefrom, and having a flat surface for mating contact with the circuit boards so as to support said circuit boards when installed on said connector; whereby, as a circuit board is installed on the connector, each contact arm is deflected toward the shoulder with which it is aligned such that a moment arm associated with each contact arm decreases in length as the contact is deflected and the contact urges against the circuit board with a force that increases non-linearly as the contact is deflected, said contact legs contacting a portion of the channel on the rear side of the insulator block when the contact is fully deflected to prevent the contact arm from sitting flat on its respective shoulder, the retaining barbs securing the circuit boards to the connector.

16. A connector for mechanically and electrically interconnecting a pair of materials having electrical conductors, comprising:

(a) an elongated insulator block having front, rear, upper and lower sides, a plurality of transverse channels extending about the front, upper and lower sides and at least partially about the rear side, and curved shoulders interval with the insulator block and disposed in the channel;

(b) a plurality of electrically conductive resilient contacts disposed in the channels, each contact having a generally C-shaped profile and an intermediate portion having generally a U-shaped projection, upper and lower ends of the contact being bifurcated along a longitudinal dimension of the contact to define upper and lower pairs of contact arms, one contact arm of each of the pairs of contact arms having a wider dimension than the other, the wider contact arm thereby having a different resonant frequency than the other contact arm, each contact arm having a generally flat portion adjacent its distal end defining a contact area for making electrical contact with the conductors, each contact arm being aligned with one of the shoulders and being normally biased away therefrom, each contact arm being deflected toward the shoulder with which it is aligned when a contact force is applied thereto and having a moment arm that decreases in length as the contact force is applied according to a non-linear function, thereby causing the contact force to increase disproportionately for each unit deflection of the contact arm and wherein each of said channels has a generally U-shaped identation slightly larger in dimension than the dimension of the U-shaped projection for receiving the U-shaped projection and permitting the contact to float in the channel.

17. A connector according to claim 16 wherein each contact arm comprises a contact leg integral with the contact arm and extending perpendicularly from the distal end thereof, the contact leg contacting a portion of the channel extending about the rear side of the insulator block when the contact arm is deflected to prevent the contact arm from sitting flat on its respective shoulder.

* * * * *